US009791792B2

(12) United States Patent
Miyauchi et al.

(10) Patent No.: US 9,791,792 B2
(45) Date of Patent: Oct. 17, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Yohei Miyauchi, Tokyo (JP); Kimihiro Yoshimura, Yokohama (JP); Harunobu Ogaki, Suntou-gun (JP); Atsushi Okuda, Yokohama (JP); Yuki Yamamoto, Tokyo (JP); Wataru Kitamura, Abiko (JP); Mai Murakami, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/132,227

(22) Filed: Apr. 18, 2016

(65) Prior Publication Data

US 2016/0327876 A1 Nov. 10, 2016

(30) Foreign Application Priority Data

May 7, 2015 (JP) ..... 2015-094849

(51) Int. Cl.
*G03G 5/05* (2006.01)
*G03G 5/147* (2006.01)

(52) U.S. Cl.
CPC ..... *G03G 5/0507* (2013.01); *G03G 5/14704* (2013.01)

(58) Field of Classification Search
CPC ..... G03G 5/0507; G03G 5/14704
See application file for complete search history.

(56) References Cited

U.S. PATENT DOCUMENTS 4,729,937 A * 3/1988 Yamazaki ..... G03G 5/08228 430/65
4,845,001 A * 7/1989 Takei ..... G03G 5/0433 430/66
5,124,219 A * 6/1992 Shintani ..... G03G 5/147 430/66
5,854,155 A * 12/1998 Kawasaki ..... C01B 21/064 423/290
5,876,890 A 3/1999 Kitamura et al.
5,912,098 A 6/1999 Tanaka et al.
5,958,644 A * 9/1999 Ueda ..... C23C 16/44 430/127
6,405,005 B1 6/2002 Kitamura et al.
6,562,530 B2 5/2003 Morikawa et al.
6,806,009 B2 10/2004 Tanaka et al.
6,815,135 B2 11/2004 Morikawa et al.
6,835,512 B2 12/2004 Morikawa et al.
6,913,862 B2 7/2005 Nakata et al.
6,991,881 B2 1/2006 Ogaki et al.
6,994,941 B2 2/2006 Tanaka et al.
6,998,210 B2 2/2006 Yoshimura et al.
7,001,699 B2 2/2006 Tanaka et al.
7,022,446 B2 4/2006 Yoshimura et al.
7,045,261 B2 5/2006 Tanaka et al.
7,078,140 B2 7/2006 Yoshimura et al.
7,364,824 B2 4/2008 Kikuchi et al.
7,413,840 B1 8/2008 Ogaki et al.
7,551,878 B2 6/2009 Ogaki et al.
7,622,238 B2 11/2009 Uematsu et al.
7,629,102 B2 12/2009 Ochi et al.
7,645,547 B2 1/2010 Okuda et al.
7,655,370 B2 2/2010 Kitamura et al.
7,704,657 B2 4/2010 Uesugi et al.
7,718,331 B2 5/2010 Uematsu et al.
7,749,667 B2 7/2010 Kawahara et al.
7,838,190 B2 11/2010 Ogaki et al.
7,875,410 B2 1/2011 Ogaki et al.
7,927,774 B2 4/2011 Ogaki et al.
7,931,848 B2 4/2011 Ochi et al.
7,979,017 B2 7/2011 Tanaka et al.
8,457,528 B2 6/2013 Ochi et al.
8,669,027 B2 3/2014 Anezaki et al.
8,753,789 B2 6/2014 Ogaki et al.
8,815,479 B2 8/2014 Shida et al.
8,846,281 B2 9/2014 Okuda et al.
8,865,380 B2 10/2014 Noguchi et al.
8,921,020 B2 12/2014 Murai et al.
8,980,508 B2 3/2015 Okuda et al.
8,980,509 B2 3/2015 Noguchi et al.
9,029,054 B2 5/2015 Okuda et al.
9,034,545 B2 5/2015 Maruyama et al.
9,063,505 B2 6/2015 Sekiya et al.
9,069,267 B2 6/2015 Kaku et al.
9,114,565 B2 8/2015 Kawai et al.
9,188,888 B2 11/2015 Okuda et al.
9,207,550 B2 12/2015 Okuda et al.

(Continued)

FOREIGN PATENT DOCUMENTS

JP 10102083 A * 4/1998
JP 2004-004146 1/2004

(Continued)

OTHER PUBLICATIONS

Springett, B.E. A Brief Introduction to Electrophotography. In Handbook of Imaging Materials; Diamond, A.S. Ed. Marcel-Dekker, Inc.: New Yorkm 2001, pp. 145-164.*

(Continued)

*Primary Examiner* — Christopher Rodee

(74) *Attorney, Agent, or Firm* — Fitzpatrick Cella Harper and Scinto

(57) ABSTRACT

An electrophotographic photosensitive member includes a surface layer with a hexagonal boron nitride dispersed therein. The hexagonal boron nitride has a graphitization index (GI) of at least 3.0 and less than 15.0.

5 Claims, 1 Drawing Sheet

(56) References Cited

U.S. PATENT DOCUMENTS 9,235,144 B2 1/2016 Yamamoto et al.
9,274,442 B2 3/2016 Sato et al.
9,280,071 B2 3/2016 Maruyama et al.
9,280,072 B2 3/2016 Ogaki et al.
9,282,615 B2 3/2016 Yamagishi et al.
9,304,416 B2 4/2016 Noguchi et al.
9,341,964 B2 5/2016 Ogaki et al.
2002/0106570 A1* 8/2002 Kami ..... G03G 5/0507 430/58.05
2008/0166643 A1* 7/2008 Bender ..... G03G 5/14704 430/66
2008/0277619 A1* 11/2008 Matsumoto ..... C08K 3/28 252/62
2008/0311206 A1* 12/2008 Student ..... A61K 8/19 424/489
2009/0311014 A1* 12/2009 Tanaka ..... G03G 5/005 399/315
2010/0310291 A1* 12/2010 Tanaka ..... G03G 5/0503 399/346
2011/0052286 A1* 3/2011 Urayama ..... G03G 5/14704 399/346
2013/0344422 A1* 12/2013 Iwanaga ..... G03G 5/14708 430/56
2014/0004450 A1 1/2014 Tokimitsu et al.
2014/0030644 A1* 1/2014 Hasegawa ..... G03G 5/05 430/56
2014/0077125 A1* 3/2014 Lin ..... C09K 5/14 252/75
2014/0093294 A1* 4/2014 Komito ..... G03G 21/0094 399/346
2014/0154618 A1 6/2014 Maruyama et al.
2014/0315124 A1 10/2014 Okuda et al.
2014/0373965 A1* 12/2014 Leist ..... C08K 3/38 138/145
2015/0056547 A1 2/2015 Murakami et al.
2015/0185630 A1 7/2015 Ito et al.
2015/0277248 A1 10/2015 Maruyama et al.
2016/0046652 A1* 2/2016 Lu ..... C07F 15/0086 257/40
2016/0060112 A1* 3/2016 Nishi ..... C08K 3/38 252/74
2016/0139556 A1 5/2016 Yamamoto et al.
2016/0154329 A1* 6/2016 Kawaguchi ..... G03G 5/04 399/111
2016/0187794 A1 6/2016 Okuda et al.
2016/0216618 A1 7/2016 Sakuma et al.
2016/0325994 A1* 11/2016 Qu ..... C01B 21/0648
2016/0333246 A1* 11/2016 Tatami ..... C01B 21/0646

FOREIGN PATENT DOCUMENTS

JP 2005-043623 2/2005
JP 2009-300861 12/2009
JP 2014-119508 6/2014
JP 2014-119586 6/2014
WO WO 2015105145 A1 * 7/2015 ..... C01B 21/0646

OTHER PUBLICATIONS

Thomas et. al, "Physical and Inorganic Chemistry", J. Am. Chem. Soc., vol. 84, No. 24 (1962) 4619-22.

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, a process cartridge having the electrophotographic photosensitive member and an electrophotographic apparatus having the electrophotographic photosensitive member.

Description of the Related Art

For example, a method for scraping off unnecessary materials and a method for sucking and removing unnecessary materials while contacting a brush-shaped or blade-shaped cleaning member with the surface of an electrophotographic photosensitive member and an intermediate transfer member are known as a method for removing transfer residual toner on the surface of an electrophotographic photosensitive member and an intermediate transfer member. Among these, a method using the blade-shaped cleaning member, that is, the so-called cleaning blade allows cleaning so efficiently with a simple constitution as to be a widely used method.

Rubber (particularly urethane rubber), which easily secures adhesion properties to the surface of an electrophotographic photosensitive member and an intermediate transfer member, is frequently used as a material for the cleaning blade. On the other hand, rubber is a material with a high friction coefficient. Thus, the occurrence of an abnormal sound (blade squeak), a deterioration in scrapability of toner due to an oscillation of the cleaning blade (toner slipping), and an phenomenon such that the cleaning blade is turned up (blade turning) were caused and were the cause of requiring great energy for securing driving torque of the electrophotographic photosensitive member.

For example, a method for making a surface layer of the electrophotographic photosensitive member contain a fluororesin component is disclosed as a technique for solving these problems in Japanese Patent Application Laid-Open No. 2005-43623. In addition, a structure for supplying metallic soap and inorganic particle from the periphery of the photosensitive member is disclosed in Japanese Patent Application Laid-Open No. 2009-300861.

SUMMARY OF THE INVENTION

However, in the method described in Japanese Patent Application Laid-Open No. 2005-43623, particularly, when the content of a fluororesin component is low, the material deteriorates due to discharge hysteresis during endurance to easily bring a rise in friction coefficient, even though friction coefficient of the initial photosensitive member may be reduced. On the other hand, when the content of a fluororesin component is high, the dispersibility of the fluororesin component into binder resin deteriorates and fluororesin is so small in refractive index as to scatter laser light and cause failure of electrostatic latent image and potential contrast and occasionally cause an abnormal image.

Further, with regard to the method described in Japanese Patent Application Laid-Open No. 2009-300861, the material is supplied from the periphery of the photosensitive member through a supply unit, so that upsizing and complication of a device are so inevitable as to cause a reduction in productivity and an increase in cost. Also, with regard to frictional properties, in metallic soap, discharge deterioration is rapidly caused and friction coefficient rises, so that a supply increases and image failure is easily caused due to filming or the like. In addition, even though boron nitride used together provides a certain resistance to discharge, but simply attaches to the metallic soap or the surface layer of the photosensitive member, and may not sufficiently provide cleavage properties and may not contribute to a reduction in friction coefficient on the surface of the photosensitive member.

The present invention is directed to providing an electrophotographic photosensitive member excellent in lubricity (low frictional properties) on the surface over an endurance use, and a process cartridge and an electrophotographic apparatus having the electrophotographic photosensitive member.

One aspect of the present invention, there is provided an electrophotographic photosensitive member including: a support; and a photosensitive layer on the support; wherein a surface layer of the electrophotographic photosensitive member includes: a binder resin; and a hexagonal boron nitride dispersed with the binder resin of the surface layer; the hexagonal boron nitride has a graphitization index (GI) of at least 3.0 and less than 15.0.

In addition, another aspect of the present invention, there is provided a process cartridge detachably attachable to a main body of an electrophotographic apparatus, the process cartridge integrally supporting: the electrophotographic photosensitive member; and at least one device selected from the group consisting of a charging device for charging a surface of the electrophotographic photosensitive member, a developing device for developing an electrostatic latent image formed on the electrophotographic photosensitive member by using a toner to form a toner image, a transfer device for transferring the toner image to a transfer medium, and a cleaning device having a cleaning blade for cleaning the electrophotographic photosensitive member while contacting with the surface of the electrophotographic photosensitive member.

In addition, still another aspect of the present invention, there is provided an electrophotographic apparatus including: the electrophotographic photosensitive member; a charging device for charging a surface of the electrophotographic photosensitive member; an image exposing device for exposing the charged electrophotographic photosensitive member to form an electrostatic latent image; a developing device for developing the electrostatic latent image formed on the electrophotographic photosensitive member by using a toner to form a toner image; a transfer device for transferring the toner image to a transfer medium; and a cleaning device having a cleaning blade for cleaning the electrophotographic photosensitive member while contacting with the surface of the electrophotographic photosensitive member.

Further features of the present invention will become apparent from the following description of exemplary embodiments with reference to the attached drawings.

DESCRIPTION OF THE EMBODIMENTS

Figure 1:
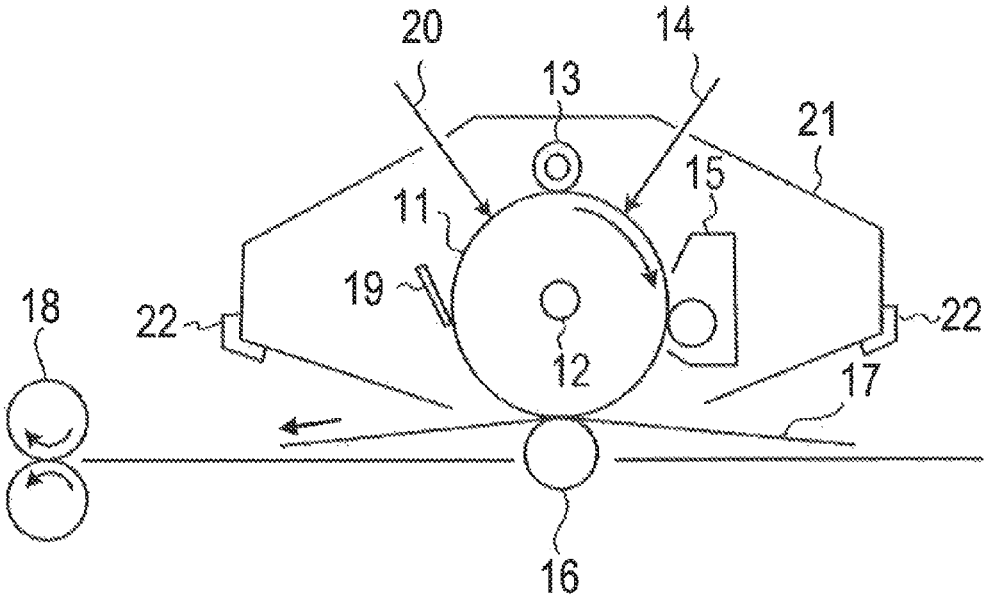
FIG. 1 is a schematic drawing showing a constitution example in an embodiment of an electrophotographic apparatus according to the present invention.

Preferred embodiments of the present invention will now be described in detail in accordance with the accompanying drawings.

(Electrophotographic Photosensitive Member)

A first embodiment in the present invention includes a surface layer containing a binder resin and a hexagonal boron nitride dispersed with the binder resin of the surface layer, and the hexagonal boron nitride has a graphitization index (GI) of at least 3.0 and less than 15.0.

The boron nitride in the present invention is a boron nitride having a hexagonal crystal type, and a crystal grows in a scaly state. The hexagonal boron nitride in which a planar structure of the boron nitride forms a laminated structure by Van der Waals force in the same manner as graphite, has the property of cleaving the laminated structure by shear force, therefore, is a material with a low friction coefficient. In addition, the hexagonal boron nitride is a material in which binding energy and heat resistance are high as compared with organic matter, and also is a material in which material resistance is high against discharge in electrophotographic process.

The degree of crystallinity of the hexagonal boron nitride in the present invention is defined by graphitization index (GI). Here, GI (graphitization index) is obtained by a calculation of GI=[area {(100)+(101)}]/[area (102)] from integrated intensity ratio, that is, area ratio of (100), (101) and (102) lines of an X-ray diffraction pattern (J. Thomas, et. al, J. Am. Chem. Soc. 84,4619 (1962)). GI is an index of crystallinity of the scaly hexagonal boron nitride, and it is known that the smaller value of this GI brings the higher crystallinity. In the present invention, GI of the hexagonal boron nitride is at least 3.0 and less than 15.0. That is to say, the present invention uses the hexagonal boron nitride with comparatively low degree of crystallinity.

Generally, in graphite having a similar hexagonal crystal structure, it is known that the higher degree of crystallinity brings cleavage more easily to provide the lower friction coefficient. However, as a result of earnest studies through the investigation of making a surface layer of the electrophotographic photosensitive member containing a boron nitride by the inventors of the present invention, it was found that being the higher degree of crystallinity does not bring cleavage more easily but rather the contrary tendency is observed out of the range of GI (less than 3.0).

As a result of zeta potential measurement of the hexagonal boron nitride and cross-sectional SEM observation of a binder resin dispersion film, due to the developed crystal in a GI of less than 3.0, it was found that the hexagonal boron nitride particles hardly cohered and are easily embedded by the binder resin. Thus, when shear force is applied to the surface layer by the cleaning blade or the like, a cleavage phenomenon is hardly caused, and friction coefficient increases. In addition, when GI is 15.0 or more, the degree of crystallinity is so small in the first place that the hexagonal boron nitride hardly cleaves, and friction coefficient increases.

On the other hand, like the present invention, when the hexagonal boron nitride, in which GI is at least 3.0 and less than 15.0, is used, affinity of the hexagonal boron nitride particles is so large by reason of comparatively low degree of crystallinity that embedding by the binder resin is hardly caused on the occasion of dispersion into the binder resin. Thus, the hexagonal boron nitride particle is hardly inhibited from cleaving even in the dispersion film, and a low friction coefficient may be realized. A range of GI used appropriately for the present invention is more preferably 4.0 or more and 11.0 or less.

Through further studies, like the present invention, it was found that a film, in which the hexagonal boron nitride is dispersed into the binder resin, had a lower friction coefficient than a film on whose surface the hexagonal boron nitride is applied by external addition. In the case of using the hexagonal boron nitride with GI in the range according to the present invention, because of an influence in which the hexagonal boron nitride is fixed while contacting partially with the resin as described above, the reason of the above is considered to be an efficient occurrence of cleavage by decrease of energy dissipation of shearing from a state of applying on the surface layer.

In the present invention, the content of the hexagonal boron nitride is preferably 1% by volume or more and 20% by volume or less with respect to the whole volume of the surface layer. The content is more preferably 5% by volume or more and 15% by volume or less. This content of the hexagonal boron nitride is a small amount as compared with the content of various fillers, such as polytetrafluoroethylene (PTFE), used for imparting lubricity to the surface layer of a conventional electrophotographic photosensitive member. When the content of the hexagonal boron nitride is 1% by volume or more, lubricity improves more easily. In addition, when the content of the hexagonal boron nitride is 20% by volume or less, the dispersibility of the hexagonal boron nitride improves and image failure is less likely to occur without deteriorating permeability of laser light.

In the present invention, the average particle diameter (median diameter $D_{50}$ on the basis of volume) of the hexagonal boron nitride is preferably 0.1 μm or more and 10 μm or less.

The hexagonal boron nitride in the present invention may be a hexagonal boron nitride in which polar functional groups such as an amino group and a hydroxyl group existing on the surface (the end of a crystal) are hydrophobically treated. The hydrophobic treatment of polar functional groups of the hexagonal boron nitride allows the potential properties and lubrication effect of the electrophotographic photosensitive member to be further improved. The hexagonal boron nitride may be produced by a method for mixing and firing boron compounds such as boric acid, boron oxide and borax with nitrogen-containing compounds such as melamine, urea and dicyanamide. The degree of crystallinity of the hexagonal boron nitride may be controlled by the firing conditions, and particularly depends greatly on the firing temperature. For example, at 1600° C. or more, it is known that GI value decreases in accordance with the increase of the firing temperature to improve the degree of crystallinity.

Here, the hydrophobic treatment includes introducing a molecule unit having various hydrophobic groups to the surface of the hexagonal boron nitride through a covalent bond by methods such as a silane coupling reaction, an ester reaction and an isocyanate reaction. A silane coupling reaction by a silane coupling agent is preferably used for the hydrophobic treatment in the present invention from the viewpoint of the convenience of handling. That is to say, the hexagonal boron nitride surface-treated with a silane coupling agent is preferably used. The hydrophobic group includes a straight-chain or branched alkyl group of C1 to C18, the alkyl group in which part of carbon atoms are substituted with double-bond carbon, triple-bond carbon or aromatic carbon, the alkyl group in which part or all of hydrogen atoms are substituted with a fluorine atom, a cycloalkyl group or an aryl group, and a group containing these. Among these, a group containing a fluorine atom, or a group with alkyl chain length of C8 or more may be used particularly appropriately from the viewpoint of the lubrication effect. In addition, a silane coupling agent not containing a chlorine atom is preferably used in consideration of the influence of a reaction product on the properties of photosensitive member.

The structure of a silane coupling agent used for the present invention is exemplified below, and the present invention is not limited to these.

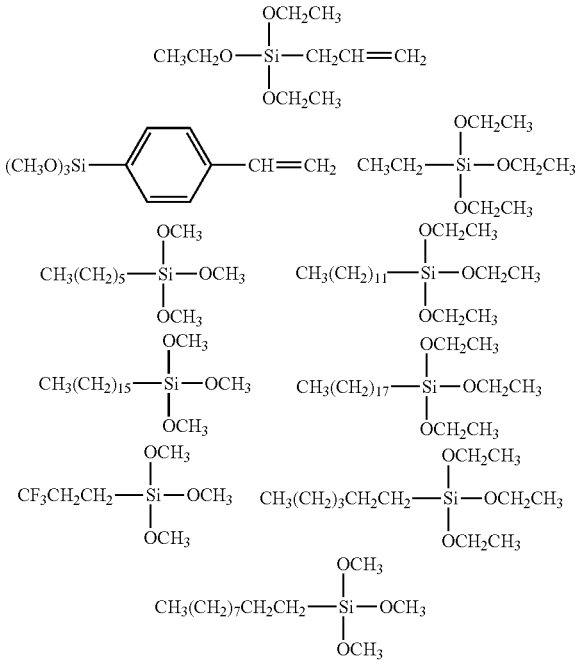

Next, the layer constitution of the electrophotographic photosensitive member is described.

The electrophotographic photosensitive member generally has a support and a photosensitive layer on the support. The photosensitive layer may be a single-layer photosensitive layer containing a charge transporting material and a charge generating material in the same layer, or a laminated photosensitive layer in which a charge generating layer containing a charge generating material and a charge transporting layer containing a charge transporting material are laminated. The laminated photosensitive layer is preferably a regular-layer type photosensitive layer obtained by laminating a charge generating layer and a charge transporting layer in the order from the side of a support.

The protective layer may be provided on the photosensitive layer and regarded as a surface layer. The protective layer may contain a conductive particle such as an electro-conductive metal oxide particle. The binder resin for the protective layer is more preferably hardening resin in view of hard surface hardness and excellent wear resistance. Examples of the hardening resin include acrylic resin, urethane resin, epoxy resin, silicone resin and phenolic resin, and are not limited thereto. The film thickness of the protective layer is preferably 0.5 μm or more and 10 μm or less, particularly preferably 1 μm or more and 7 μm or less.

The surface layer of the electrophotographic photosensitive member signifies a layer located in the surface of the electrophotographic photosensitive member (the most distant layer from the support). For example, in the case of providing the protective layer, the surface layer of the electrophotographic photosensitive member is the protective layer. In the case of not providing the protective layer and in the case where the photosensitive layer is the single-layer photosensitive layer, the surface layer of the electrophotographic photosensitive member is the single-layer photosensitive layer. In the case of not providing the protective layer and in the case where the photosensitive layer is the regular-layer type photosensitive layer, the surface layer of the electrophotographic photosensitive member is the charge transporting layer.

The support can be a support having an electrical conductivity (an electro-conductive support). Specific examples thereof include a support made of metal such as aluminum, nickel, copper, gold and iron, or alloys of these; a support in which a thin film of metal such as aluminum, silver and gold, or electro-conductive material such as indium oxide and tin oxide is formed on an insulating support such as polyester, polycarbonate, polyimide and glass with; and a support in which carbon black or electro-conductive filler is dispersed in resin to impart the electrical conductivity.

The surface of the support may be subjected to electrochemical treatment such as anodic oxidation for improving electrical characteristics and adhesion properties. The surface of the support may be subjected to chemical treatment with a solution in which a compound of a metal salt or a metal salt of a fluorine compound is dissolved in an acid aqueous solution having alkali phosphate, phosphoric acid or tannic acid as the main component.

In the case where single-wavelength light such as laser light is used as image exposure light, the surface of the support is preferably roughened for restraining interference fringe. Specifically, the surface of the support may be roughened in such a manner that the surface of the support is subjected to treatment such as honing, blast, cutting and electropolishing, and an electro-conductive film made of electro-conductive metal oxide and binder resin is provided on the surface of the support.

The honing treatment includes dry and wet treating methods. The wet honing treatment is a method in which a powdery abrasive is suspended in a liquid such as water and sprayed on the surface of the support at high speed to roughen the surface of the support. The surface roughness of the support may be controlled by spray pressure; speed; amount, kind, shape, size, hardness, and specific gravity of abrasive; and suspension temperature. The dry honing treatment is a method in which an abrasive is sprayed on the surface of the support at high speed by air to roughen the surface of the support, and may control the surface roughness of the support in the same manner as the wet honing treatment. Examples of the abrasive used for the honing treatment include a particle such as silicon carbide, alumina, iron and glass.

A conductive layer for the purpose of restraining interference fringe due to single-wavelength light such as laser light and covering a flaw on the surface of the support may be provided between the support and the photosensitive layer or the after-mentioned undercoat layer.

The conductive layer may be formed by applying a coating liquid for the conductive layer obtained by dispersing a conductive particle such as carbon black, a metal particle and a metal oxide particle together with binder resin and solvent, and drying/hardening the obtained coating film. Examples of the metal oxide particle include zinc oxide particle and titanium oxide particle. Barium sulfate particle may be used as the conductive particle. The conductive particle may be a composite particle obtained by providing a covering layer on a core particle.

The volume resistivity of conductive particles is preferably 0.1 Ω·cm or more and 1000 Ω·cm or less, more preferably 1 Ω·cm or more and 1000 Ω·cm or less. This volume resistivity is a value obtained by measuring with the use of a resistance measuring apparatus Loresta AP manufactured by Mitsubishi Yuka Co., Ltd. (the present: Mitsubishi Chemical Analytech Co., Ltd.). A measurement sample is a coin-shaped sample obtained by fixing conductive particles at a pressure of 49 MPa.

The volume-average particle diameter of conductive particles is preferably 0.05 μm or more and 1.0 μm or less, more preferably 0.07 μm or more and 0.7 μm or less. This volume-average particle diameter is a value measured by a centrifugal sedimentation method.

The content of a conductive particle in the conductive layer is preferably 1% by mass or more and 90% by mass or less, more preferably 5% by mass or more and 80% by mass or less with respect to the whole mass of the conductive layer.

Examples of binder resin used for the conductive layer include phenolic resin, polyurethane, polyamide, polyimide, polyamideimide, polyvinyl acetal, epoxy resin, acrylic resin, melamine resin and polyester. These may be used by only one kind or by two kinds or more as a mixture or a copolymer. Among these, phenolic resin, polyurethane and polyamide are preferable in view of favorable adhesive property to the support, high dispersibility of a conductive particle, and favorable solvent resistance after forming the conductive layer.

The film thickness of the conductive layer is preferably 0.1 μm or more and 30 μm or less, more preferably 0.5 μm or more and 20 μm or less.

The volume resistivity of the conductive layer is preferably $10^{13}$ Ω·cm or less, more preferably $10^{5}$ Ω·cm or more and $10^{12}$ Ω·cm or less. This volume resistivity is a value obtained in such a manner that a film is formed on an aluminum plate by the same material as the conductive layer to be measured, on whose film a golden thin film is formed to measure a current value between the aluminum plate and the golden thin film with a pA meter.

A leveling agent may be added to the conductive layer for improving the surface property of the conductive layer.

An undercoat layer (also referred to as an intermediate layer) having a barrier function and an adhesive property improving function may be provided between the support or the conductive layer and the photosensitive layer (a charge generating layer, a charge transporting layer). The undercoat layer is provided for adhesive property improvement of the photosensitive layer, coating property improvement, charge injection property improvement from the support, and protection of the photosensitive layer against electrical breakdown.

The undercoat layer may be formed by applying a coating liquid for the undercoat layer obtained by dissolving resin in a solvent, and drying the obtained coating film.

Examples of the resin used for the undercoat layer include acrylic resin, allyl resin, alkyd resin, ethyl cellulose resin, ethylene-acrylic acid copolymer, epoxy resin, casein resin, silicone resin, gelatin resin, phenolic resin, butyral resin, polyacrylate, polyacetal, polyamideimide, polyamide, polyallyl ether, polyimide, polyurethane, polyester, polyethylene, polycarbonate, polystyrene, polysulfone, polyvinyl alcohol, polybutadiene, polypropylene and urea resin.

The film thickness of the undercoat layer is preferably 0.05 μm or more and 5 μm or less, more preferably 0.3 μm or more and 3 μm or less.

The photosensitive layer is formed on the support, the conductive layer or the undercoat layer.

In the case where the photosensitive layer is the laminated photosensitive layer, the charge generating layer may be formed by applying a coating liquid for the charge generating layer obtained by dispersing a charge generating material together with binder resin and solvent, and drying the obtained coating film.

The ratio between the charge generating material and the binder resin is preferably in a range of 1:0.3 or more and 1:4 or less (mass ratio).

Examples of the charge generating material include dyes or pigments such as pyrylium, thiapyrylium, phthalocyanine, anthoanthrone, dibenzopyrenequinone, cyanine, trisazo, bisazo, monoazo, indigo, quinacridone and asymmetric quinocyanine. Among these, a phthalocyanine pigment is preferable. Examples of the phthalocyanine pigment include oxytitanium phthalocyanine, chlorogallium phthalocyanine, dichlorotin phthalocyanine and hydroxygallium phthalocyanine.

Examples of the binder resin used for the charge generating layer include acrylic resin, methacrylic resin, allyl resin, alkyd resin, epoxy resin, diallyl phthalate resin, silicone resin, styrene-butadiene copolymer, cellulosic resin, phenolic resin, butyral resin, benzal resin, melamine resin, polyacrylate, polyacetal, polyamideimide, polyamide, polyallyl ether, polyarylate, polyimide, polyurethane, polyester, polyethylene, polycarbonate, polystyrene, polysulfone, polyvinyl acetal, polyvinyl methacrylate, polyvinyl acrylate, polybutadiene, polypropylene, urea resin, vinyl chloride-vinyl acetate copolymer, vinyl acetate resin and vinyl chloride resin. Among these, butyral resin is preferable. These may be used singly or as a mixture or a copolymer by one kind or by two kinds or more.

Examples of the solvent used for the coating liquid for the charge generating layer include alcohol, sulfoxide, ketone, ether, ester, aliphatic halogenated hydrocarbon and aromatic compound.

The film thickness of the charge generating layer is preferably 0.01 μm or more and 5 μm or less, more preferably 0.01 μm or more and 2 μm or less, furthermore preferably 0.05 μm or more and 0.3 μm or less.

A sensitizer, an antioxidant, an ultraviolet absorber, a plasticizer and an electron conveyance agent may be added to the charge generating layer.

In the case where the photosensitive layer is the laminated photosensitive layer, the charge transporting layer may be formed by applying a coating liquid for the charge transporting layer obtained by dissolving a charge transporting material and binder resin in a solvent, and drying the obtained coating film. In the case where the charge transporting layer is the surface layer, the hexagonal boron nitride described above is added to the coating liquid for the charge transporting layer.

Examples of the charge transporting material include a triarylamine compound, a hydrazone compound, a styryl compound, a stilbene compound, a pyrazoline compound, an oxazole compound, a thiazole compound and a triarylmethane compound. One kind or two or more kinds of these charge transporting materials may be used.

Examples of the binder resin used for the charge transporting layer include acrylic resin, methacrylic resin, acrylonitrile resin, allyl resin, alkyd resin, epoxy resin, silicone resin, phenolic resin, phenoxy resin, butyral resin, polyacrylamide, polyacetal, polyamideimide, polyamide, polyallyl ether, polyarylate, polyimide, polyurethane, polyester, polyethylene, polycarbonate, polystyrene, polysulfone, polyvinyl butyral, polyphenylene oxide, polybutadiene, polypropylene, urea resin, vinyl chloride resin and vinyl acetate resin. Among these, polyarylate and polycarbonate are preferable.

Examples of the solvent used for the coating liquid for the charge transporting layer include alcohol, sulfoxide, ketone, ether, ester, aliphatic halogenated hydrocarbon and aromatic compound.

The ratio between the charge transporting material and the binder resin is preferably in a range of 2:1 or more and 1:2 or less (mass ratio).

The film thickness of the charge transporting layer is preferably 5 μm or more and 50 μm or less, more preferably 7 μm or more and 30 μm or less.

Additive agents such as an antioxidant, an ultraviolet absorber, a plasticizer, a fluorine atom-containing resin particle and a silicone compound may be added to the charge transporting layer.

In the case where the photosensitive layer is the single-layer photosensitive layer, the photosensitive layer may be formed by applying a coating liquid for the photosensitive layer obtained by dispersing the charge generating material and charge transporting material described above together with the binder resin and solvent described above, and drying the obtained coating film.

The film thickness of the single-layer photosensitive layer is preferably 5 μm or more and 40 μm or less, more preferably 15 μm or more and 30 μm or less.

In order to provide higher durability to the electrophotographic photosensitive member, hardening resin may be used as resin (binder resin) of the surface layer of the electrophotographic photosensitive member. Examples of the hardening resin include thermosetting phenolic resin, melamine resin, urethane resin, epoxy resin, urea resin, unsaturated polyester, siloxane resin obtained by a sol-gel method, thermosetting polyimide and alkyd resin. In addition, resins obtained by cross-linking a compound having an unsaturated bond such as an acrylic compound (monomer of acrylic resin), a methacrylic compound (monomer of methacrylic resin), an allyl compound, a vinyl compound, an epoxy compound having a ring partial structure, and an oxetane compound while utilizing radial rays such as ultraviolet rays and electron rays may be used. Further, in recent years, a method of using resin, which is obtained by cross-linking a compound having a charge transporting structure and a polymerizable functional group such as an acryloyloxy group and a hydroxy group together while using heat, ultraviolet rays and electron rays, to the surface layer is proposed for restraining the residual of electric charge in the surface layer. In the present invention, such a cross-linking material may be also used as binder resin of the surface layer of the electrophotographic photosensitive member.

In the case of using a cross-linking material for the surface layer, a cross-linking reaction is not particularly limited but a cross-linking reaction according to the object, such as dehydration condensation reaction, polyaddition reaction and unsaturated polymerization reaction, may be properly adopted.

Additive agents such as an antioxidant, an ultraviolet absorber, a plasticizer, a fluorine atom-containing resin particle and a silicone compound may be added to the surface layer of the electrophotographic photosensitive member.

In the case of dispersing on the occasion of producing a coating liquid for each of the layers, examples of the dispersing method include a method using homogenizer, ultrasonic dispersion, ball mill, vibratory ball mill, sand mill, attritor, roll mill and liquid collision high-speed disperser.

Coating methods such as an immersion applying method (an immersion coating method), spray coating method, spinner coating method, roller coating method, meyer bar coating method and blade coating method may be used for applying a coating liquid for each of the layers. The viscosity of the coating liquid is preferably 5 Pa·s or more and 500 mPa·s or less from the viewpoint of coating property. The treatment of the coating film obtained by applying is generally hot-air drying treatment, and ultraviolet rays, electron rays and infrared rays may be also irradiated for improving strength of the layers.

(Process Cartridge and Electrophotographic Apparatus)

Next, a process cartridge and an electrophotographic apparatus having the electrophotographic photosensitive member of the present invention are described. The process cartridge and the electrophotographic apparatus are a second embodiment and a third embodiment respectively in the present invention.

The process cartridge of the present invention is detachably attachable to a main body of an electrophotographic apparatus, in which the process cartridge integrally supports the electrophotographic photosensitive member of the present invention and at least one device selected from the group consisting of a charging device for charging a surface of the electrophotographic photosensitive member, a developing device for developing an electrostatic latent image formed on the electrophotographic photosensitive member by using a toner to form a toner image, a transfer device for transferring the toner image to a transfer medium, and a cleaning device having a cleaning blade for cleaning the electrophotographic photosensitive member while contacting with the surface of the electrophotographic photosensitive member.

The electrophotographic apparatus of the present invention has the electrophotographic photosensitive member of the present invention, a charging device for charging a surface of the electrophotographic photosensitive member, an image exposing device for exposing the charged electrophotographic photosensitive member to form an electrostatic latent image imagewise, a developing device for developing the electrostatic latent image formed on the electrophotographic photosensitive member by using a toner to form a toner image, a transfer device for transferring the toner image to a transfer medium, and a cleaning device having a cleaning blade for cleaning the electrophotographic photosensitive member while contacting with the surface of the electrophotographic photosensitive member.

The transfer residual toner on the surface of the electrophotographic photosensitive member is removed by the cleaning blade of a cleaning device. The linear pressure per unit length in the longitudinal direction (the rotation axis direction of the electrophotographic photosensitive member) in a contact region between the electrophotographic photosensitive member and the cleaning blade during cleaning is generally determined at 300 $mN/cm^2$ or more and 1200 $mN/cm^2$ or less. Even in such a range of the linear pressure, the use of the electrophotographic photosensitive member excellent in lubricity (low frictional properties) on the surface of the present invention provides favorable cleaning properties.

FIG. 1 is a schematic drawing showing a constitution example in an embodiment of the electrophotographic apparatus according to the present invention. The embodiment of the electrophotographic apparatus shown in FIG. 1 is a constitution provided with the process cartridge having the electrophotographic photosensitive member of the present invention.

In FIG. 1, a cylindrical electrophotographic photosensitive member 11 of the present invention is rotationally driven with an axis 12 as the center on the arrow direction (the clockwise direction) at a predetermined circumferential velocity.

The surface (peripheral surface) of the electrophotographic photosensitive member 11 driven rotationally is charged with positive potential or negative potential by a charging device 13, and subsequently exposed to exposure light (image exposure light) 14 output from the image exposing device (not shown in Figure). Thus, an electrostatic latent image corresponding to an intended image is formed on the surface of the electrophotographic photosensitive member 11.

Examples of the charging device 13 include a corona charging device using corotron and scorotron, and a contact charging device using a roller, a brush and a film. The voltage applied on the charging device may be only direct-current voltage or direct-current voltage superposed with alternating-current voltage.

Examples of the exposing device include slit exposure and laser-beam scanning exposure.

The electrostatic latent image formed on the surface of the electrophotographic photosensitive member 11 is developed by a developing device 15 with the use of a toner stored in the developing device 15, and formed into a toner image. Examples of a development system include a system of developing in contact or non-contact while using a magnetic or non-magnetic developer of one component or two components (toner as a one-component developer, or toner and carrier as a two-component developer).

Examples of the toner include polymerization toner by suspension polymerization and emulsion polymerization, and toner conglobated by mechanical crushing method and conglobation treatment. The weight-average particle diameter of the toner is preferably 4 μm or more and 7 μm or less, and the average degree of circularity of the toner is preferably 0.95 or more and 0.99 or less.

The toner image formed on the surface of the electrophotographic photosensitive member 11 is sequentially transferred to a transfer medium (paper or the like) 17 by a transfer device 16. The transfer medium 17 is taken out from a transfer medium supply device (not shown in Figure) and fed to (the contact part) between the electrophotographic photosensitive member 11 and the transfer device 16 while synchronized with the rotation of the electrophotographic photosensitive member 11.

Incidentally, the toner image formed on the surface of the electrophotographic photosensitive member may be sequentially transferred to a transfer medium (paper or the like) through an intermediate transfer member by a transfer device of an intermediate transfer system having an intermediate transfer member. In the case of using the transfer device of an intermediate transfer system, the toner image is primarily transferred from the surface of the electrophotographic photosensitive member onto an intermediate transfer member by a primary transfer device. The primary transfer is not limited to one time, but the intended toner image may be formed onto an intermediate transfer member by plural times, such as the total four times of each color of yellow, magenta, cyan and black. Subsequently, the toner image on the intermediate transfer member is secondarily transferred from the intermediate transfer member to a transfer medium by a secondary transfer device, and an unfixed toner image is formed on the transfer medium.

The transfer medium 17 on which the toner image is transferred is separated from the surface of the electrophotographic photosensitive member 11, introduced to a fixing device 18, subjected to image fixation, and thereby printed out as an image formation (print, copy) outside of the electrophotographic apparatus.

A cleaning blade 19 as the cleaning device removes the transfer residual toner from the surface of the electrophotographic photosensitive member 11 after transferring the toner image in accordance with the rotation of the electrophotographic photosensitive member while contacting with the surface of the electrophotographic photosensitive member 11 at a predetermined linear pressure. Thereafter, the electrophotographic photosensitive member 11 is charge eliminated by pre-exposure light 20 from a pre-exposing device (not shown in Figure), and used repeatedly for image formation.

Among the components selected from the electrophotographic photosensitive member 11, the charging device 13, the developing device 15, the transfer device 16 and the cleaning blade 19 as the cleaning device, plural components including the electrophotographic photosensitive member 11 are stored in a vessel, and united and constituted integrally as a process cartridge, which may be constituted detachably attachable to the electrophotographic apparatus body. In FIG. 1, the electrophotographic photosensitive member 11, the charging device 13, the developing device 15 and the cleaning blade 19 as the cleaning device are integrally supported and made into a cartridge, and regarded as a process cartridge 21, which is detachably attachable to the electrophotographic apparatus body by using a guide device 22 such as a rail provided in the electrophotographic apparatus body.

EXAMPLES

The present invention is hereinafter described in further detail while referring to specific examples. However, the present invention is not limited to these examples. 'Part' in the examples signifies part by mass.

Example 1

An aluminum cylinder with a diameter of 30 mm and a length of 260 mm was used as a support.

Next, 50 parts of titanium oxide particles coated with tin oxide containing antimony oxide of 10% by mass, 25 parts of resole phenolic resin, 30 parts of methoxypropanol, 30 parts of methanol, and 0.002 part of silicone oil (polydimethylsiloxane polyoxyalkylene copolymer, weight-average molecular weight: 3000) were put in a sand mill using glass beads with a diameter of 1 mm, and dispersed for 2 hours to thereby prepare a coating liquid for a conductive layer. This coating liquid for a conductive layer was immersed and applied on the support, and the obtained coating film was hardened for 20 minutes at 140° C. to thereby form a conductive layer with a film thickness of 20 μm.

Next, 5 parts of N-methoxymethylated 6 nylon were dissolved in 95 parts of methanol to thereby prepare a coating liquid for an undercoat layer. This coating liquid for an undercoat layer was immersed and applied on the conductive layer, and the obtained coating film was dried for 20 minutes at 100° C. to thereby form an undercoat layer with a film thickness of 0.5 μm.

Next, 10 parts of hydroxygallium phthalocyanine crystal (a charge generating material) of a crystal form having a peak at Bragg angles (2θ±0.2°) of 7.5°, 9.9°, 12.5°, 16.3°, 18.6°, 25.1° and 28.3° in CuKα characteristic X-ray diffraction, 0.1 part of a compound represented by the following structural formula (1), (1)

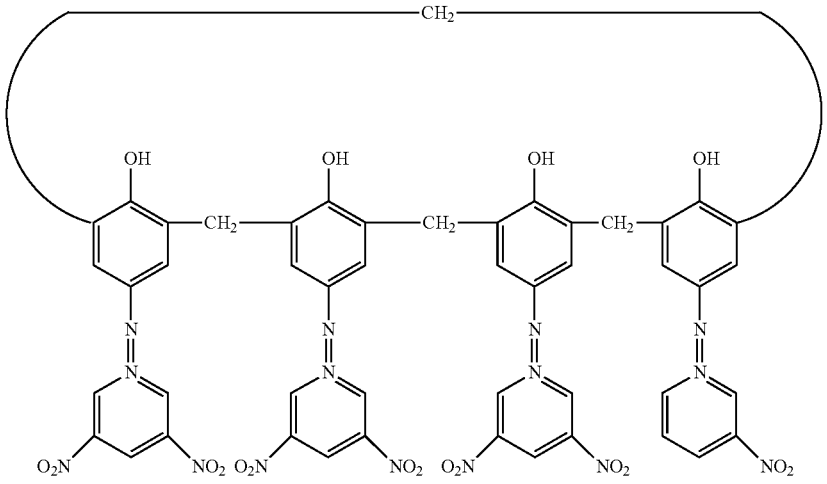

5 parts of polyvinyl butyral (trade name: S-LEC BX-1, manufactured by SEKISUI CHEMICAL CO., LTD.), and 250 parts of cyclohexanone were put in a sand mill using glass beads with a diameter of 1 mm, and dispersed for 1 hour. And then, 250 parts of ethyl acetate was added to the obtained mixture, and a coating liquid for a charge generating layer was prepared. This coating liquid for a charge generating layer was immersed and applied on the undercoat layer, and the obtained coating film was dried for 10 minutes at 100° C. to thereby form a charge generating layer with a film thickness of 0.16 μm.

Next, 40 parts of a compound (a charge transporting material) represented by the following structural formula (2), (2)

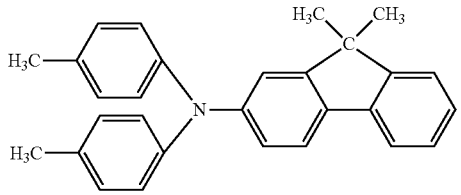

5 parts of a compound (a charge transporting material) represented by the following structural formula (3), (3)

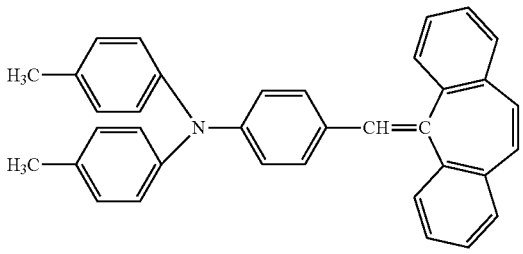

and 50 parts of polyarylate (weight-average molecular weight: 115000, mole ratio between terephthalic acid skeleton and isophthalic acid skeleton: terephthalic acid skeleton/isophthalic acid skeleton=50/50) having a structural unit represented by the following structural formula (4)

(4)

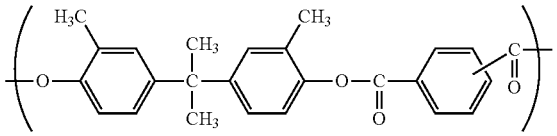

were dissolved in 300 parts of monochlorobenzene to thereby obtain a charge transporting material dissolving solution.

On the other hand, 100 parts of tetrahydrofuran, 33 parts of hexagonal boron nitride particles (GI=3.3, manufactured by Denki Kagaku Kogyo Company Limited. (the present: Denka Company Limited.)), and glass beads with a diameter of 1 mm were put in a paint shaker, and dispersed for 1 hour to thereby obtain a hexagonal boron nitride fluid dispersion.

The obtained charge transporting material dissolving solution and hexagonal boron nitride fluid dispersion were mixed and stirred so that the volume fraction of the hexagonal boron nitride in a charge transporting layer after drying was 5% by volume to thereby prepare a coating liquid for a charge transporting layer. This coating liquid for a charge transporting layer was immersed and applied on the charge generating layer, and the obtained coating film was dried for 1 hour at 120° C. to thereby form a charge transporting layer (a surface layer) with a film thickness of 20 μm.

The resultant was an electrophotographic photosensitive member of Example 1.

Example 2

An electrophotographic photosensitive member was produced in the same manner as Example 1 except for using hexagonal boron nitride with a different GI value (GI=4.0, manufactured by Denki Kagaku Kogyo Company Limited.). The film thickness of a charge transporting layer after drying was 21 μm.

Example 3

An electrophotographic photosensitive member was produced in the same manner as Example 1 except for using hexagonal boron nitride with a different GI value (GI=7.5, manufactured by Denki Kagaku Kogyo Company Limited.). The film thickness of a charge transporting layer after drying was 20 μm.

Example 4

An electrophotographic photosensitive member was produced in the same manner as Example 1 except for using hexagonal boron nitride with a different GI value (GI=10.8, manufactured by Denki Kagaku Kogyo Company Limited.). The film thickness of a charge transporting layer after drying was 20 μm.

Example 5

An electrophotographic photosensitive member was produced in the same manner as Example 1 except for using hexagonal boron nitride with a different GI value (GI=14.0, manufactured by Denki Kagaku Kogyo Company Limited.). The film thickness of a charge transporting layer after drying was 21 μm.

Example 6

An electrophotographic photosensitive member was produced in the same manner as Example 3 except for mixing and stirring hexagonal boron nitride so that the volume fraction of the hexagonal boron nitride in a charge transporting layer after drying was 10% by volume. The film thickness of a charge transporting layer after drying was 21 μm.

Example 7

An electrophotographic photosensitive member was produced in the same manner as Example 3 except for mixing and stirring hexagonal boron nitride so that the volume fraction of the hexagonal boron nitride in a charge transporting layer after drying was 15% by volume. The film thickness of a charge transporting layer after drying was 21 μm.

Reference Example 8

An electrophotographic photosensitive member was produced in the same manner as Example 3 except for mixing and stirring hexagonal boron nitride so that the volume fraction of the hexagonal boron nitride in a charge transporting layer after drying was 25% by volume. The film thickness of a charge transporting layer after drying was 21 μm.

Example 9

The formation was performed up to the charge generating layer in the same manner as Example 1.

Next, 40 parts of a compound (a charge transporting material) represented by the structural formula (2), 5 parts of a compound (a charge transporting material) represented by the structural formula (3), and 50 parts of polyarylate (weight-average molecular weight: 115000, mole ratio between terephthalic acid skeleton and isophthalic acid skeleton: terephthalic acid skeleton/isophthalic acid skeleton=50/50) having a structural unit represented by the structural formula (4) were dissolved in 300 parts of monochlorobenzene to thereby obtain a charge transporting material dissolving solution. This charge transporting material dissolving solution was a coating liquid for a charge transporting layer in this Example, and laminated on the charge generating layer by immersing and applying. The film thickness of this charge transporting layer was 20 μm.

Next, 10 parts of hexagonal boron nitride (GI=7.5, manufactured by Denki Kagaku Kogyo Company Limited.), 47 parts of a compound (a monomer of methacrylic resin) represented by the following structural formula (5), and 143 parts of ethanol were put in a paint shaker, and dispersed for 2 hours to thereby prepare a coating liquid for a protective layer.

(5)

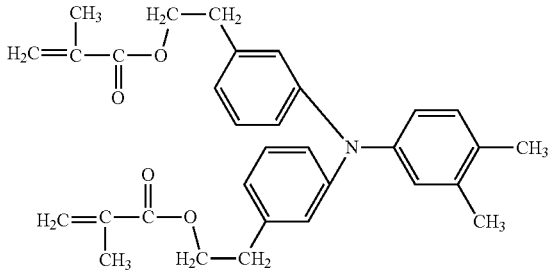

This coating liquid for a protective layer was immersed and applied on the charge transporting layer, and the obtained coating film was irradiated and cured with electron rays under a nitrogen atmosphere to thereby form a cross-linking protective layer (a surface layer) and produce an electrophotographic photosensitive member. The film thickness of the protective layer was 3.0 μm. Incidentally, hexagonal boron nitride was contained by 10% by volume with respect to the whole volume of the protective layer after curing.

Example 10

5 parts of hexagonal boron nitride (GI=7.5, manufactured by Denki Kagaku Kogyo Company Limited.) were added to 9 parts of a mixed solvent of water/ethanol=1/9. Next, 0.1 part of octadecyltrimethoxysilane (manufactured by Tokyo Chemical Industry Co., Ltd.) as a silane coupling agent was added thereto, and a small amount of acetic acid was added. After that, zirconia beads with a diameter of 1 mm were added, and stirred with a paint shaker for 3 hours. Thereafter, the reaction solution was washed in toluene three times and dried at 170° C. for 1 hour to obtain hexagonal boron nitride surface-treated with silane coupling treatment.

Next, an electrophotographic photosensitive member was produced in the same manner as Example 3 except for using the hexagonal boron nitride obtained in the above. The film thickness of a charge transporting layer after drying was 21 μm.

Example 11

An electrophotographic photosensitive member was produced in the same manner as Example 10 except for using n-decyltriethoxysilane (manufactured by Tokyo Chemical Industry Co., Ltd.) as a silane coupling agent. The film thickness of a charge transporting layer after drying was 20 μm.

Example 12

An electrophotographic photosensitive member was produced in the same manner as Example 10 except for using trimethoxy(1H,1H,2H,2H-heptadecafluorodecyl)silane (manufactured by Tokyo Chemical Industry Co., Ltd.) as a silane coupling agent. The film thickness of a charge transporting layer after drying was 20 μm.

Comparative Example 1

An electrophotographic photosensitive member having a charge transporting layer as the surface layer was produced in the same manner as Example 1 except for using hexagonal boron nitride with a different GI value (GI=0.9, manufactured by Denki Kagaku Kogyo Company Limited.). The film thickness of the charge transporting layer after drying was 20 μm.

Comparative Example 2

An electrophotographic photosensitive member having a charge transporting layer as the surface layer was produced in the same manner as Example 1 except for using hexagonal boron nitride with a different GI value (GI=1.5, manufactured by Denki Kagaku Kogyo Company Limited.). The film thickness of the charge transporting layer after drying was 20 μm.

Comparative Example 3

An electrophotographic photosensitive member having a charge transporting layer as the surface layer was produced in the same manner as Example 1 except for using hexagonal boron nitride with a different GI value (GI=2.8, manufactured by Denki Kagaku Kogyo Company Limited.). The film thickness of the charge transporting layer after drying was 20 μm.

Comparative Example 4

An electrophotographic photosensitive member having a charge transporting layer as the surface layer was produced in the same manner as Example 1 except for using hexagonal boron nitride with a different GI value (GI=15.2, manufactured by Denki Kagaku Kogyo Company Limited.). The film thickness of the charge transporting layer after drying was 20 μm.

Comparative Example 5

The formation was performed up to the charge generating layer in the same manner as Example 1.

Next, 100 parts of polytetrafluoroethylene (PTFE) powder (RUBURON L-2, manufactured by DAIKIN INDUSTRIES, LTD.), 5 parts of a surfactant (GF-300, manufactured by TOAGOSEI CO., LTD.), 315 parts of toluene, and glass beads with a diameter of 1 mm were put in a paint shaker, and dispersed for 1 hour to produce PTFE fluid dispersion. Subsequently, the charge transporting material dissolving solution described in Example 1 and the produced PTFE fluid dispersion were mixed and stirred so that the PTFE content in a charge transporting layer after drying was 5% by volume to prepare a coating liquid for a charge transporting layer. This coating liquid for a charge transporting layer was immersed and applied on the charge generating layer, and the obtained coating film was dried for 1 hour at 120° C. to thereby form a charge transporting layer (a surface layer) of 20 μm and then an electrophotographic photosensitive member was produced.

Comparative Example 6

The formation was performed up to the charge generating layer in the same manner as Example 1.

Next, the charge transporting material dissolving solution described in Example 1 was used as a coating liquid for a charge transporting layer in the Comparative Example, and immersed and applied on the charge generating layer, and the obtained coating film was dried for 1 hour at 120° C. to thereby form a charge transporting layer of 20 μm. Subsequently, 5 parts of hexagonal boron nitride (GI=7.5, manufactured by Denki Kagaku Kogyo Company Limited.), 95 parts of ethanol, and glass beads with a diameter of 1 mm were put in a paint shaker, and dispersed for 1 hour to produce hexagonal boron nitride fluid dispersion. This hexagonal boron nitride fluid dispersion was immersed and applied on the charge transporting layer, and the obtained coating film was dried for 10 minutes at 120° C. to produce an electrophotographic photosensitive member.

Comparative Example 7

An electrophotographic photosensitive member having a charge transporting layer as the surface layer was produced in the same manner as Example 6 except for using cubical crystal boron nitride (manufactured by SHOWA DENKO K.K.) as boron nitride. The film thickness of the charge transporting layer after drying was 20 μm.

The details of the electrophotographic photosensitive members produced in the above are shown in Table 1.

(Evaluation Method)

(Evaluation of Blade Squeak and Turning)

With regard to the evaluation, first, the produced electrophotographic photosensitive member was mounted on a process cartridge for a laser beam printer (LBP) manufactured by Hewlett-Packard (trade name: LASER JET 4300n (monochrome machine)). The image output (endurance test) of 2000 sheets was performed with this LBP to evaluate the presence or absence of blade turning and blade squeak in the stages of the first five sheets (the initial) and the last five sheets (the latter half of the endurance test).

(Measurement of Coefficient of Kinetic Friction)

Figure 2:
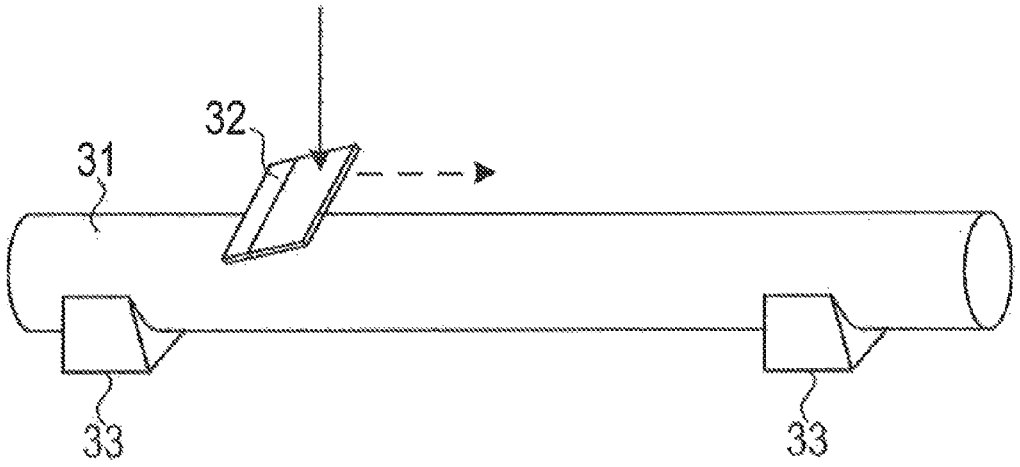
FIG. 2 is a drawing explaining a measuring method for coefficient of kinetic friction in examples of the present invention.

With regard to the measurement of coefficient of kinetic friction, the change of coefficient of kinetic friction in a urethane blade with a JIS-A hardness of 70° and the electrophotographic photosensitive member was measured. The produced electrophotographic photosensitive member after the usage of initial consecutive 2,000-sheet paper feeding, which was used for the evaluation of the blade squeak and turning, was taken out of the evaluation equipment. With regard to this electrophotographic photosensitive member, as shown in FIG. 2, a urethane blade 32 was placed on the surface of an electrophotographic photosensitive member 31 on the conditions of a vertical load of 30 g and a rubbing rate of 100 mm/min by using a surface nature measuring apparatus Type 14FW (manufactured by SHINTO Scientific Co., Ltd.) so as to have a contact angle of 26° and a contact pressure of 30 g, and a coefficient of kinetic friction was measured. Incidentally, the electrophotographic photosensitive member 31 was fixed with a fastener 33.

The obtained coefficient of kinetic friction was regarded as a coefficient of kinetic friction during paper feeding (endurance use). Also, the coefficient of kinetic friction of the urethane blade 32 which was measured preliminarily before evaluating the blade squeak and turning was regarded as an initial coefficient of kinetic friction.

Incidentally, in FIG. 2, the solid line arrow (the arrow vertically downward) denotes the vertical load on the urethane blade 32, and the broken line arrow (the arrow horizontally leftward) denotes the direction of movement of the urethane blade 32.

(Potential Characteristic)

The electrophotographic property was measured under an environment of 23° C./50% RH by using a drum electrophotographic photosensitive member testing device ('CYNTHIA59', manufactured by GEN-TECH, INC.).

With regard to the measuring method, the primary current was controlled so that a potential $V_0$ at a location of a potential probe became −700 V, by negative charging with the use of corona discharge while rotated at 60 rpm in a dark place. Here, monochromatic light (775 nm) made by a filter was irradiated by using a halogen lamp as a light source to measure an exposure amount until the surface potential decreased to ½ of $V_0$ (namely, −350 V), and regarded the half-value exposure amount $E_{1/2}$ [μJ/cm$^2$] as sensitivity. In addition, the pre-exposure step of charge eliminating while applying energy of 15 μJ/cm$^2$ by a light-emitting diode with a wavelength of 700 nm after charge/exposure was performed, and the potential with the passage of 0.3 second after finishing the exposure in the pre-exposure step was regarded as a residual potential (Vr) [−V].

The evaluation results described above are shown in Table 1.

TABLE 1

| | SURFACE LAYER RESIN | FILLER | SURFACE TREATMENT | FILLER CONDITIONS GI | FILLER CONDITIONS CONTENT [vol %] | FRICTION COEFFICIENT DURING INITIAL | FRICTION COEFFICIENT DURING PAPER FEEDING | BLADE SQUEAK | BLADE TURNING | POTENTIAL PROPERTIES $E_{1/2}$ [μJ/cm$^2$] | POTENTIAL PROPERTIES Vr [−V] |
|---|---|---|---|---|---|---|---|---|---|---|---|
| EXAMPLE 1 | POLY-ARYLATE | HEXAGONAL BORON NITRIDE | — | 3.3 | 5 | 0.78 | 0.82 | ABSENT | ABSENT | 0.34 | 75 |
| EXAMPLE 2 | POLY-ARYLATE | HEXAGONAL BORON NITRIDE | — | 4.0 | 5 | 0.75 | 0.80 | ABSENT | ABSENT | 0.37 | 76 |
| EXAMPLE 3 | POLY-ARYLATE | HEXAGONAL BORON NITRIDE | — | 7.5 | 5 | 0.70 | 0.78 | ABSENT | ABSENT | 0.33 | 77 |
| EXAMPLE 4 | POLY-ARYLATE | HEXAGONAL BORON NITRIDE | — | 10.8 | 5 | 0.76 | 0.80 | ABSENT | ABSENT | 0.36 | 81 |
| EXAMPLE 5 | POLY-ARYLATE | HEXAGONAL BORON NITRIDE | — | 14.0 | 5 | 0.84 | 0.87 | ABSENT | ABSENT | 0.38 | 84 |
| EXAMPLE 6 | POLY-ARYLATE | HEXAGONAL BORON NITRIDE | — | 7.5 | 10 | 0.68 | 0.67 | ABSENT | ABSENT | 0.39 | 88 |
| EXAMPLE 7 | POLY-ARYLATE | HEXAGONAL BORON NITRIDE | — | 7.5 | 15 | 0.61 | 0.63 | ABSENT | ABSENT | 0.40 | 89 |
| REFERENCE EXAMPLE 8 | POLY-ARYLATE | HEXAGONAL BORON NITRIDE | — | 7.5 | 25 | 0.60 | 0.64 | ABSENT | ABSENT | 0.42 | 93 |
| EXAMPLE 9 | METH-ACRYLIC RESIN | HEXAGONAL BORON NITRIDE | — | 7.5 | 10 | 0.67 | 0.77 | ABSENT | ABSENT | 0.33 | 72 |
| EXAMPLE 10 | POLY-ARYLATE | HEXAGONAL BORON NITRIDE | surface treated | 7.5 | 5 | 0.72 | 0.80 | ABSENT | ABSENT | 0.25 | 51 |
| EXAMPLE 11 | POLY-ARYLATE | HEXAGONAL BORON NITRIDE | surface treated | 7.5 | 5 | 0.74 | 0.81 | ABSENT | ABSENT | 0.22 | 53 |
| EXAMPLE 12 | POLY-ARYLATE | HEXAGONAL BORON NITRIDE | surface treated | 7.5 | 5 | 0.66 | 0.77 | ABSENT | ABSENT | 0.24 | 52 |
| COMPAR-ATIVE EXAMPLE 1 | POLY-ARYLATE | HEXAGONAL BORON NITRIDE | — | 0.90 | 5 | 1.31 | 1.57 | PRESENT | PRESENT | 0.33 | 72 |
| COMPAR-ATIVE EXAMPLE 2 | POLY-ARYLATE | HEXAGONAL BORON NITRIDE | — | 1.5 | 5 | 1.24 | 1.45 | PRESENT | PRESENT | 0.32 | 74 |
| COMPAR-ATIVE EXAMPLE 3 | POLY-ARYLATE | HEXAGONAL BORON NITRIDE | — | 2.8 | 5 | 1.02 | 1.00 | PRESENT | PRESENT | 0.36 | 74 |
| COMPAR-ATIVE EXAMPLE 4 | POLY-ARYLATE | HEXAGONAL BORON NITRIDE | — | 15.2 | 5 | 1.00 | 1.04 | PRESENT | PRESENT | 0.38 | 75 |
| COMPAR-ATIVE EXAMPLE 5 | POLY-ARYLATE | PTFE | — | — | 5 | 0.91 | 1.38 | PRESENT | PRESENT | 0.30 | 63 |
| COMPAR-ATIVE EXAMPLE 6 | SURFACE APPLICA-TION | HEXAGONAL BORON NITRIDE | — | 7.5 | — | 0.87 | 0.95 | SLIGHTLY PRESENT | PRESENT | 0.30 | 65 |
| COMPAR-ATIVE EXAMPLE 7 | POLY-ARYLATE | Cubical Crystal BORON NITRIDE | — | — | 10 | 1.10 | 1.40 | PRESENT | PRESENT | 0.37 | 80 |

Through Table 1, it was found that hexagonal boron nitride changed in the coefficient of kinetic friction in accordance with the degree of crystallinity, and when GI became 3.0 or more, the coefficient of kinetic friction decreased greatly and changed on a small scale over the endurance use of the electrophotographic process. In addition, it was found that the film dispersed with hexagonal boron nitride was low in the coefficient of kinetic friction as compared with a film containing PTFE by the same amount, and was so excellent in resistance to electrical deterioration (endurance use) as to have superiority to conventional materials. Further, it was found that the coefficient of kinetic friction decreased in the film dispersed with hexagonal boron nitride as compared with the case of coating the electrophotographic photosensitive member from the exterior (forming the coating film).

In addition, it was found that the potential characteristic improved in the case of using boron nitride surface-treated with a silane coupling agent.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-094849, filed May 7, 2015, which is hereby incorporated by reference herein in its entirety.

What is claimed is:

1. An electrophotographic photosensitive member comprising:

a support; and a photosensitive layer on the support, wherein a surface layer of the electrophotographic photosensitive member comprises a binder resin with a hydrophobically treated hexagonal boron nitride dispersed therein, the hexagonal boron nitride having a graphitization index (GI) of 3.0 to less than 15.0, and a content of the hexagonal boron nitride is 1 to 20% by volume with respect to the whole volume of the surface layer.

2. The electrophotographic photosensitive member according to claim 1, wherein the hexagonal boron nitride is surface-treated with a silane coupling agent.

3. The electrophotographic photosensitive member according to claim 1, wherein a content of the hexagonal boron nitride is 5-15% by volume with respect to the whole volume of the surface layer.

4. A process cartridge detachably attachable to a main body of an electrophotographic apparatus, the process cartridge integrally supporting:

an electrophotographic photosensitive member; and at least one device selected from the group consisting of:

a charging device for charging a surface of the electrophotographic photosensitive member, a developing device for developing an electrostatic latent image formed on the electrophotographic photosensitive member by using a toner to form a toner image, a transfer device for transferring the toner image to a transfer medium, and a cleaning device having a cleaning blade for cleaning the electrophotographic photosensitive member while contacting with the surface of the electrophotographic photosensitive member;

the electrophotographic photosensitive member comprising a support, and a photosensitive layer on the support, wherein a surface layer of the electrophotographic photosensitive member comprises a binder resin with a hydrophobically treated hexagonal boron nitride dispersed therein, the hexagonal boron nitride having a graphitization index (GI) of 3.0 to less than 15.0, and a content of the hexagonal boron nitride is 1 to 20% by volume with respect to the whole volume of the surface layer.

5. An electrophotographic apparatus comprising:

an electrophotographic photosensitive member;

a charging device for charging a surface of the electrophotographic photosensitive member;

an image exposing device for exposing the charged electrophotographic photosensitive member to form an electrostatic latent image;

a developing device for developing the electrostatic latent image formed on the electrophotographic photosensitive member by using a toner to form a toner image;

a transfer device for transferring the toner image to a transfer medium; and a cleaning device having a cleaning blade for cleaning the electrophotographic photosensitive member while contacting with the surface of the electrophotographic photosensitive member;

the electrophotographic photosensitive member comprising a support, and a photosensitive layer on the support, wherein a surface layer of the electrophotographic photosensitive member comprises a binder resin with a hydrophobically treated hexagonal boron nitride dispersed therein, the hexagonal boron nitride having a graphitization index (GI) of 3.0 to less than 15.0, and a content of the hexagonal boron nitride is 1 to 20% by volume with respect to the whole volume of the surface layer.

* * * * *